US010876190B2

(12) United States Patent
Foster

(10) Patent No.: US 10,876,190 B2
(45) Date of Patent: Dec. 29, 2020

(54) METHOD OF FORMING COMPONENTS FROM SHEET MATERIAL

(71) Applicant: IMPRESSION TECHNOLOGIES LIMITED, Coventry (GB)

(72) Inventor: Alistair Foster, Coventry (GB)

(73) Assignee: IMPRESSION TECHNOLOGIES LIMITED, Coventry (GB)

( * ) Notice: Subject to any disclaimer, the term of this patent is extended or adjusted under 35 U.S.C. 154(b) by 420 days.

(21) Appl. No.: 15/780,940

(22) PCT Filed: Dec. 5, 2016

(86) PCT No.: PCT/GB2016/053830

§ 371 (c)(1),
(2) Date: Jun. 1, 2018

(87) PCT Pub. No.: WO2017/093767

PCT Pub. Date: Jun. 8, 2017

(65) Prior Publication Data

US 2018/0305800 A1 Oct. 25, 2018

(30) Foreign Application Priority Data

Dec. 4, 2015 (GB) ..... 1521443

(51) Int. Cl.
*C22F 1/04* (2006.01)
*C22F 1/06* (2006.01)

(52) U.S. Cl.
CPC . *C22F 1/04* (2013.01); *C22F 1/06* (2013.01)

(58) Field of Classification Search
CPC ..... C22F 1/04
(Continued)

(56) References Cited

U.S. PATENT DOCUMENTS 3,850,763 A 11/1974 Zinnbauer et al.
2012/0145287 A1 6/2012 Kim et al.
2012/0152416 A1* 6/2012 Foster ..... C22F 1/00 148/695

FOREIGN PATENT DOCUMENTS

DE 102010027554 1/2012
JP 2003268472 9/2003
(Continued)

OTHER PUBLICATIONS

Yanagimoto, J. et al. "Controlled Semisolid Forging of Aluminum Alloys Using Mechanical Servo Press to Manufacture Products with Homo- and Heterogeneous Microstructures", Materials Transactions, vol. 54, No. 7, pp. 1149-1154 (2013).
(Continued)

*Primary Examiner* — Coris Fung
*Assistant Examiner* — Danielle M. Carda
(74) *Attorney, Agent, or Firm* — Meunier Carlin & Curfman LLC

(57) ABSTRACT

The present invention provides a method of forming a component (40) from an alloy sheet of material (30) having at least a Solvus temperature and a Solidus temperature of a precipitation hardening phase, the method comprising the steps of: heating the sheet (30) to above its Solvus temperature; initiating forming the heated sheet (30) between matched tools (32, 34) of a die press and forming by means of plastic deformation towards a final shape whilst allowing the average temperature of the sheet (30) to reduce at a first predetermined rate A; interrupting the forming of the sheet for a predetermined first interruption period P1 prior to achieving said final shape; and, during the interrupt holding the sheet of material with reduced or no deformation and allowing the average temperature of the sheet to reduce at a second predetermined rate B lower than or equal to the first predetermined rate in order to allow for a reduction in
(Continued)

dislocations and completing the forming of the heated sheet into the final shape whilst allowing the sheet to cool at a third rate C greater than said second rate B.

17 Claims, 13 Drawing Sheets

(58) Field of Classification Search
USPC ..... 148/667
See application file for complete search history.

(56) References Cited

FOREIGN PATENT DOCUMENTS

| | | | |
|---|---|---|---|
| WO | 2008/059242 | A2 | 5/2008 |
| WO | 2015/136299 | A2 | 9/2015 |

OTHER PUBLICATIONS

Communication pursuant to Rule 114(2) EPC dated May 8, 2019, from related EP application No. 16809515.6, 10 pages.
Relevance of third-party observations filed on Apr. 29, 2019, from related EP application No. 16809515.6, 5 pages.
Jeon, J. et al. "Two-Step Die Motion for Die Quenching of AA2024 Aluminum Alloy Billet on Servo Press", Materials Transactions, vol. 55, No. 5 (2014), pp. 818-826.
International Search Report and Written Opinion dated Feb. 15, 2017, from International Application No. PCT/GB2016/053830, 12 pages.
Combined Search and Examination Report under Sections 17 and 18(3) dated Jul. 17, 2017, from Application No. GB1620682.3, 5 pages.

* cited by examiner

METHOD OF FORMING COMPONENTS FROM SHEET MATERIAL

TECHNICAL FIELD

The present invention relates to an improved method of forming components and more particularly forming components from alloyed sheet metal in a die press. The method is particularly suitable for the formation of formed components having a complex shape which cannot be formed easily using known techniques.

BACKGROUND

To improve the environmental performance of automotive vehicles, vehicle OEMs are moving towards lightweight alloys for formed components. Traditionally, there was considerable trade-off between the strength of the alloy used and the formability of the alloy. However, new forming techniques such as HFQ® have allowed more complex parts to be formed from high-strength lightweight alloy grades such as 2xxx, 5xxx, 6xxx and 7xxx series aluminium (Al) alloys.

Age hardening Al-alloy sheet components are normally cold formed either in the T4 condition (solution heat treated and quenched), followed by artificial ageing for higher strength, or in the T6 condition (solution heat treated, quenched and artificially aged). Either condition introduces a number of intrinsic problems, such as spring-back and low formability which are difficult to solve. Similar disadvantages may also be experienced during forming of components from other materials, such as magnesium and its alloys. With these traditional cold forming processes, it is often the case that formability improves inversely with forming speed. Two mechanisms that may effect this outcome are: improved material ductility at lower deformation speeds; and Improved lubrication at lower speeds.

A disadvantage with conventional techniques in which artificial ageing is performed after the forming process is that the ageing process parameters cannot be optimised for all locations of a part simultaneously. The kinetics of ageing are related to the amount of deformation applied, which is not uniform over a formed component. The effect of this is that regions or parts of a formed component may be sub-optimal.

In an effort to overcome these disadvantages, various efforts have been undertaken and special processes have been invented to overcome particular problems in forming particular types of components.

One such technique utilises Solution Heat Treatment, forming, and cold-die quenching (HFQ®) as described by the present inventors in their earlier application WO02008/059242. In this process an Al-alloy blank is solution heat treated and rapidly transferred to a set of cold tools which are immediately closed to form a shaped component. The formed component is held in the cold tools during cooling of the formed component.

With HFQ® forming, the logical processes of traditional cold forming must be reversed. At elevated temperatures (commonly thought of as above 0.6 of the melting temperature) strain hardening is very low and therefore deformation has a tendency to localise leading to low formability even though the material ductility is high. To counteract this, HFQ® benefits from the viscoplastic hardening of the material at high deformation rates which aids the flow of material across the tool. Thus, formability improves with increased forming speed.

Undesirably, by the same mechanism the amount of dislocation annealing (recovery) that occurs during forming is also reduced due to the reduced forming time. This leads to disparate ageing kinetics across the part.

The mechanism of dislocation annealing is sometimes referred to as static recovery of dislocations. For a given metal alloy, the rate of static recovery is a function of temperature and the density of dislocations. The dislocation recovery rate is higher with increased temperature and increased dislocation density.

A microstructure having an initial high density of dislocations will have a high initial recovery rate and, as the density of dislocations reduces, the rate of dislocation recovery will also reduce.

For 6xxx alloys, such as 6082, it is well accepted that precipitation sequence response for Al—Si—Mg alloys is based on the Mg2Si precipitates and represented by the following stages:

$$SSS \rightarrow GP\ zones \rightarrow \beta'' \rightarrow \beta' \rightarrow \beta$$

where SSS denotes the supersaturated solid solution, GP zones are the Guinier-Preston zones, β", β' are the metastable phases and β is the equilibrium phase.

A similar process is seen in 7xxx alloys. However, the chemistry of the precipitates may vary between alloys within the 7xxx series.

As an example, two possible precipitation sequences for an 7xxx alloy are:

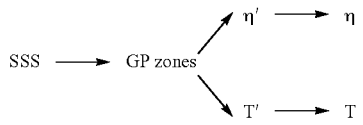

where SSS denotes the supersaturated solid solution, GP zones are the Guinier-Preston zones, η' or T' are the metastable phases and η or T are the equilibrium phase. It will be appreciated that these are examples and other undesirables may precipitate.

On quenching from Solution Heat Treatment it is desirable to ensure no metastable prime precipitate phases or stable precipitate phases are formed, as these precipitates will reduce the super saturated alloy content available to precipitate the most desirable hardened microstructure during subsequent age hardening.

In practice, time-temperature-precipitation (TTP) curves for various alloys can be created or identified from the literature. These may be formatted to show the locus of points at which unwanted precipitate phases will form or alternatively to show the locus of points for which the final mechanical properties are affected by an incomplete quench. Either representation may be used to determine the quench sensitivity of the alloy, the latter being based on final macroscopic mechanical properties and the former on examination of the microstructure.

Quench efficiency may be defined as the percentage of the mechanical properties achieved compared to those of an infinitely fast quench. A typical graphical representation of a 7075 alloy is shown in FIG. 13 of the drawings attached hereto and illustrates where the divide is between the time-temperature-precipitation area leading to above 99.5% effective quench and the time-temperature-precipitation area, if encroached during the quench from SHT, that would result in a reduction in age-hardening response greater than 0.5%. The figure also illustrates where the device is for achieving a quench efficiency of above 70%. The figure has been constructed from literature data of J. Robinson et al., Mater Charact, 65:73-85, 2012 and is used for example purposes only.

It is an aim of the present invention to provide a process for forming metal components which mitigates or ameliorates at least one of the problems of the prior art, or provides a useful alternative.

SUMMARY OF INVENTION

According to the present invention there is provided a method of forming a component from an alloy sheet of material having at least a Solvus temperature of a precipitating hardening phase and a Solidus temperature, the method comprising the steps of a. heating the sheet to above its Solvus temperature;
b. initiating forming the heated sheet between matched tools of a die press and forming by means of plastic deformation towards a final shape whilst allowing the average temperature of the sheet to reduce at a first predetermined rate A;
c. interrupting the forming of the sheet for a pre-determined first interruption period P1 prior to achieving said final shape; and, during the interrupt holding the sheet of material with reduced or no deformation and allowing the average temperature of the sheet to reduce at a second pre-determined rate B lower than or equal to the first predetermined rate in order to allow for a reduction in dislocations.
d. completing the forming of the heated sheet into the final shape whilst allowing the sheet to cool at a third rate C greater than said second rate B.

The sheet material may be heated to within its Solution Heat Treatment temperature range during step (a).

The sheet material may be formed to at least 50% of its final form during the initial forming step (b). Alternatively, the sheet material may be formed to at least 90% of its final form during the initial forming step (b)

The method may include a second interruption period P2 after the first interrupt period P1 and before completion of the forming in step (d). Alternatively, the method may include multiple further interruption periods PX after the first interrupt period P1 and before completion of the forming in step (d).

On completion of the forming in step (d) the sheet metal may be held under load between the matched tooling to further reduce the temperature of the finished component 40.

When the method includes one or more interruption periods P1, P2, PX, one or more of said one or more interruption periods may include the step of holding the matched tools in position. Alternatively, when the method includes one or more interruption periods P1, P2, PX, one or more of said one or more interruption periods may include the step of reversing the matched tools. In a still further alternative, when the method includes one or more interruption periods P1, P2, PX, one or more of said one or more interruption periods may include the step of holding and reversing the matched tools.

When the method includes one or more interruption periods P1, P2, PX, the method may include the step of terminating the interruption period or periods prior to the precipitation of undesirable precipitates from the super saturated solid solution.

The temperature of the sheet may be maintained at a temperature of between 350° C. and 500° C. during the interrupt of step (b). Alternatively, the temperature of the sheet may be maintained at a temperature above 250° C. during the interrupt of step (b).

The matched tools may be maintained at a temperature of between −5° C. and +120° C. during the interrupt step (b).

The interrupt step may be maintained for a time such as to ensure the Dislocation Density is reduced whilst avoiding the Precipitation of unwanted phases.

The alloy being formed may comprise an aluminium alloy. Such an alloy may be selected from the list consisting or comprising 2xxx, 6xxx or 7xxx alloys. The alloy may be a magnesium alloy such as, for example AZ91.

In one arrangement the sheet is held during the interrupt without deformation.

The method may include the step of maintaining the metal sheet blank within the Solution Heat Treatment temperature range until Solution Heat Treatment is complete.

In one specific example, the blank may be heated to between 470° C. and 490° C. which is typical for 7075 alloy. In another example the blank may be heated to between 525° C. and 560° C. which is typical of 6082 alloy.

The method may also include the step of holding the finished component between the matched tools after completion of step (d).

BRIEF DESCRIPTION OF FIGURES

Embodiments of the present invention will now be described by way of example and with reference to the accompanying Figures, in which.

SPECIFIC DESCRIPTION

Figure 1:
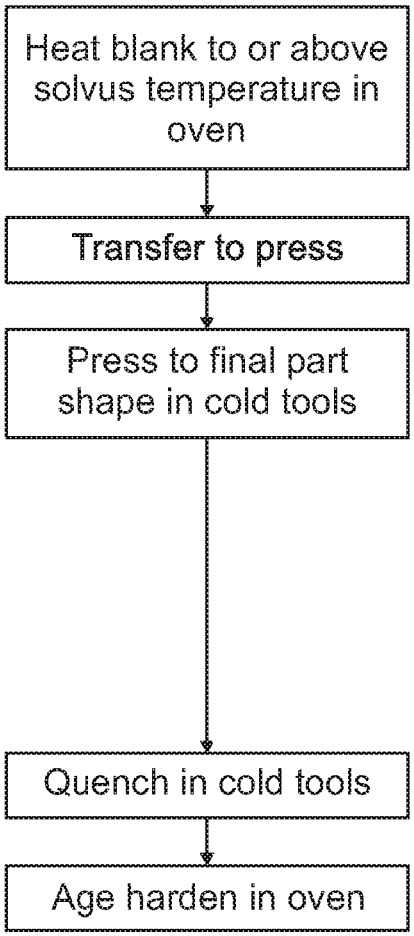
FIG. 1 is a flow diagram showing an operation profile according to conventional processes.

FIG. 1 illustrates a conventional pressing process for forming components from metal sheet blanks. The first stage comprises heating the sheet blank to at least its solvus temperature in, for example an oven or a heating station. The solvus temperature is an intrinsic property of the specific metal or alloy being formed. The sheet blank is then transferred to a press, such as a hydraulic press. The press closure is initiated and the matched tools act to press the sheet and form the component into its final form in one step.

The component is quenched in the cold tools and under load, and age hardened in an oven to obtain the desired level of hardening. The final product can then be cooled and used. Whilst this arrangement is able to form complex shapes, the full final form of the complex shape is gained rapidly and the subsequent quench step between cold tools may result in lower than desired dislocation recovery and the desired material properties are not achieved.

Figure 2:
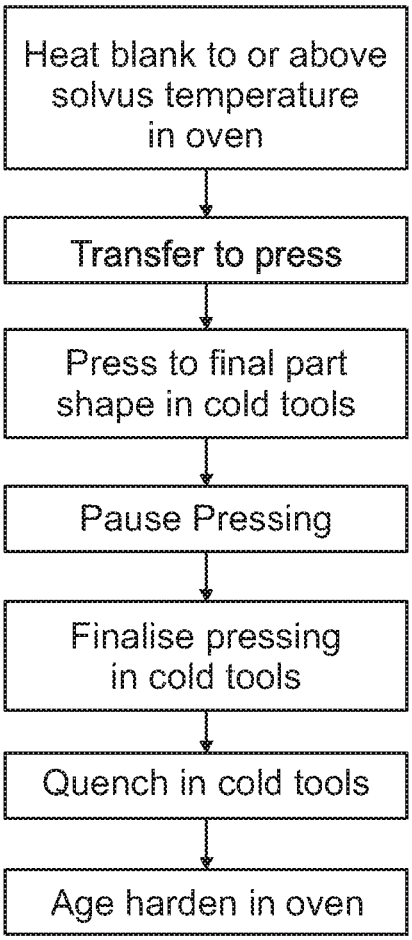
FIG. 2 is a flow diagram according to an embodiment of the invention.

The present invention aims to reduce and possibly eliminate the disadvantages of the prior art arrangement of FIG. 1 by adopting the process of FIG. 2 which shares a number of the process steps of the prior art but introduces an interruption step which is used to enhance the material properties of the final component.

Referring now specifically to FIG. 2, a metal sheet or blank 10, of, for example, an alloy sheet is heated to or above its solvus temperature and, preferably, within its Solution Heat Treatment temperature range in an oven 20 before being transferred to a press 30 and inserted between cooled matched tools 32, 34 which are profiled to the shape of the desired component 40, as in the conventional processes of FIG. 1. The press is operated according to the present invention such as to move the press tools together at a first pre-determined rate A to initiate forming of the metal sheet blank 10 but, prior to the completion of the forming step, the press 30 is interrupted and the matched tools 32, 34 are held in position and possibly backed-off, part way between their initial position and their final position, where the forming of the component would be complete. This interruption step and the advantages associated therewith are discussed in detail later herein but it will be appreciated that the interruption will reduce and possibly eliminate the forming load for a short period. After the interruption step has been completed, the press 30 is restarted and the matched tools 32, 34 close to the final position, completing forming of the component. As per the conventional processes, the now fully formed component 40 is then held in the cold matched tools 32, 34 in order to quench the now formed component. A subsequent age hardening step is carried out in an oven, as in the prior art.

Figure 12:
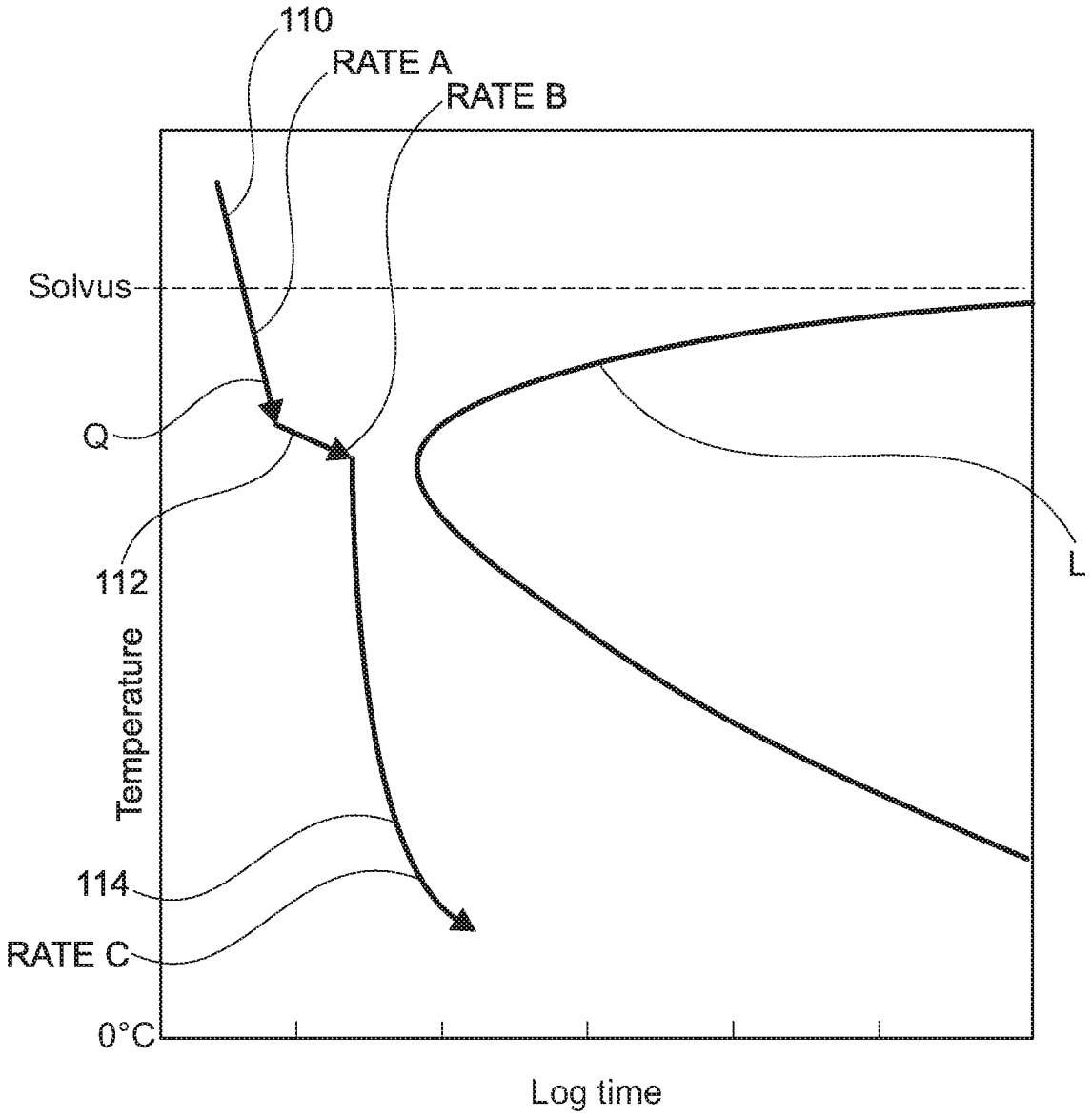
FIG. 12 is a diagrammatic representation of the cooling profile adopted by the present invention where L indicates the Locus of Time-Temperature-Precipitation points at which unwanted precipitates will occur.

FIG. 12 illustrates the above-described process in more detail and from which it will be appreciated that the sheet 30 is heated to above its Solvus temperature before being placed between the matched tools 32, 34 and forming initiated by moving the matched tools 32, 34 towards each other at a first rate whilst causing or allowing the average temperature of the sheet to reduce at a first predetermined rate A. The interrupt step allows for the sheet 30 to be held with reduced or no deformation taking place whilst allowing the average temperature of the sheet 30 to reduce at a second pre-determined rate B which may be equal or less than pre-determined rate A. By providing this interruption step the present invention is able to provide a degree of management of the final material properties of the component to be formed. Once the interrupt is completed the pressing process is recommenced and the heated sheet is formed into the final shape whilst causing or allowing the sheet to cool at a third rate C greater than said second rate B.

It will be appreciated that the forming steps result in plastic deformation of the sheet blank which is largely accommodated at the microstructure level by the formation of dislocations. The dislocations will undergo formation due to plastic strain and will undergo recovery due to dynamic and static recovery mechanisms.

Static recovery of dislocations is a time-dependent mechanism. Therefore, by holding the material with little or no deformation during the interrupt step, the dislocation density can be reduced. However, static recovery is also a temperature dependent process that occurs fastest at higher temperatures and it is, thus, desirable to maintain the sheet blank at as high a temperature as reasonably possible in order to allow for the greatest reduction in dislocations.

In view of the above, it is preferable to form the component to at least 50% and preferably up to at least 90% of its final form in the initial forming step (b) such that the interrupt can take place whilst the sheet is still at a relatively high average temperature. Whilst the average temperature may vary, it has been found that the sheet should be maintained at above at least 250° C. and preferably at a temperature of between 350° C. and 500° C. In one specific example, the blank is heated to between 470° C. and 490° C. (7075 alloy). In another example the blank is heated to between 525° C. and 560° C. (typical of 6082 alloy).

As the temperature of the aluminium drops below the solvus temperature, the microstructure enters an unstable state known as a super-saturated solid solution. In this condition, the alloying elements responsible for forming the hardening phase will start to precipitate out. If precipitation occurs during the forming stage, the precipitates will not form in the correct manner and this will adversely affect the final material. Therefore, it is beneficial for the step(s) of dislocation recovery to take place at temperatures high enough to ensure dislocation recovery occurs substantially faster than undesirable precipitation from the super-saturated solid solution.

In order to reduce the rate of cooling during the interrupt (c), one or both of the matched tools 32, 34 may be moved away from the sheet 10 in order to allow the sheet temperature to partially or wholly equilibrate. This also reduces the overall cooling rate of the component being formed as the relatively cold matched tools 32, 34 will have less influence on the cooling rate and thus permit the maximum possible time for the dislocations to be reduced while minimising the precipitation of alloying elements.

During the forming steps the material is in changing contact with the relatively cold matched tools 32, 34. This can result in a thermal profile across the sheet with cool spots and hot spots in both the sheet and matched tools 32, 34. As a result, cold portions of the sheet blank will recover more slowly than hotter portions. This problem may also be somewhat overcome by moving the matched tools 32, 34 apart or away from the sheet, or reducing the pressure so as to reduce the thermal contact during any interruption.

The above interrupt can be carried out in multiple steps in order to sequentially form portions of the component and allow the dislocations to reduce without the average temperature of the sheet blank 10 dropping too quickly and we now describe a number of possible operation profiles with reference to FIGS. 3A to 3D which shown a series of operation profiles showing ram displacement (y axis) against time (x axis).

Figure 3A:
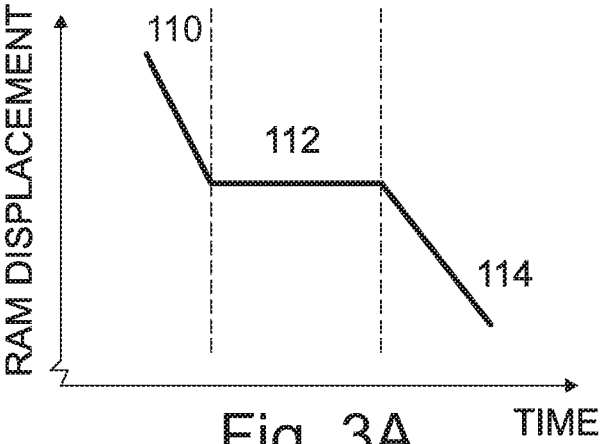
FIGS. 3A to 3D are diagrams showing operation profiles according to embodiments of the invention.

FIG. 3A shows a first profile with a first pressing step 110, wherein the matched tools 32, 34 are closed together, a first interruption step 112, wherein the tools are held in position, and a second pressing step 114, wherein the tools are closed to their final position and the component is fully formed.

Figure 3B:
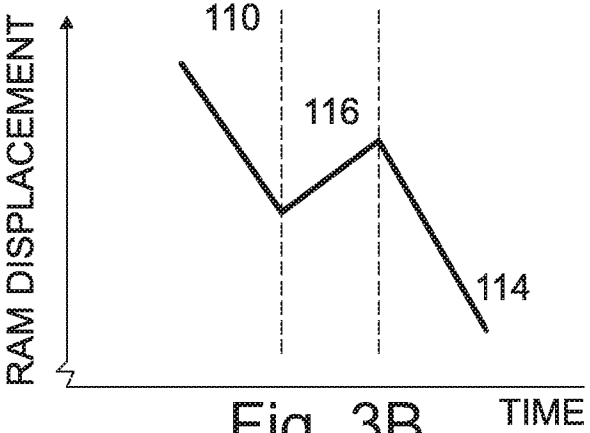

FIG. 3B shows a second profile with first and second pressing steps 112, 114 and a second interruption step 116, wherein the tools are reversed. During the interruption step 116, one or more of the tools may be moved so that it no longer contacts the sheet blank being formed.

Figure 3C:
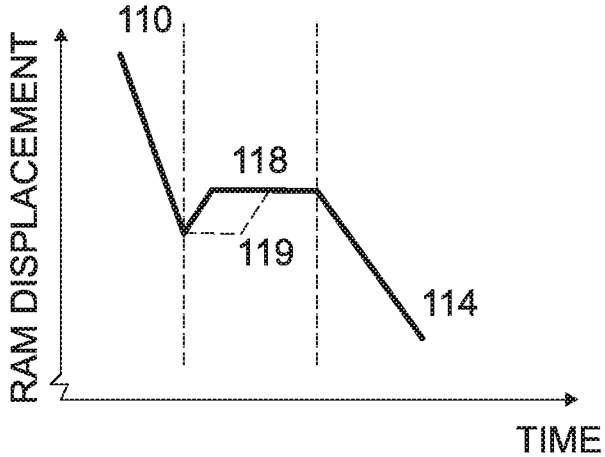

FIG. 3C shows a third profile with first and second pressing steps 112, 114 and a third interruption step 118. The third interruption step may be described as a compound interruption step, since during the third interruption step 118, the tools are first reversed (i.e. moved relatively apart) and then held in position. A fourth profile is shown in a dashed line, showing a fourth interruption step 119 (also a compound interruption step) wherein the tools are first held in position, reversed, and then held in position for a second time before the second pressing step 14 is carried out. The third and fourth interruption steps 118, 119 are merely exemplary embodiments, and it is expected that the interruptions may comprise any combination of holding the tools in position and reversing the tools away from each other.

Figure 3D:
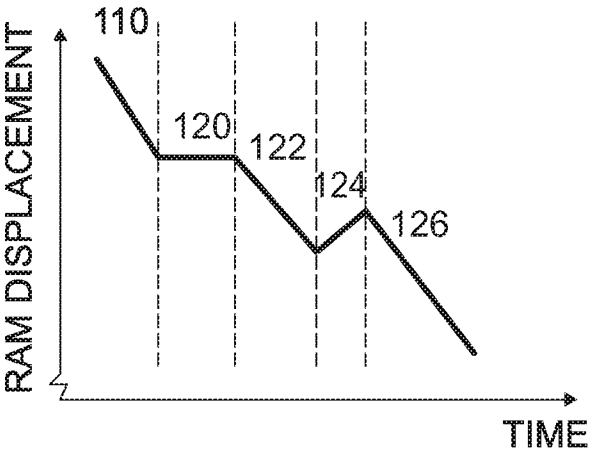

FIG. 3D shows a fifth profile, which has a first pressing step 110; followed by first interruption step 120 and then a second pressing step 122 followed by a second interruption step 124 and, then a final pressing step 126. During the first interruption step 120 the tools are held in position, but during the second interruption step 124 the tools are reversed. The second pressing step 122 is carried out at a much slower rate (i.e. shallower line) than the first or final pressing steps 110, 126.

FIGS. 3A-D are intended as exemplary profiles to show potential methods of forming components according to the invention. It is to be envisaged that many combinations of the interruption steps in FIGS. 3A to 3D are possible and desirable depending on the shape of the component to be formed and the properties of the metal or alloy from which it is to be produced. For example, the process may comprise multiple interruption steps, each of which may be compound interruption steps as shown in FIG. 3C. The first and second pressing steps, and optionally any additional pressing steps depending on the number of interruptions, may all be carried out at different speeds, depending on the requirements for the component to be formed. It will also be appreciated that the speeds of each pressing step may be different to each other. For example, the first or early pressing steps may be faster than subsequent pressing steps. In addition, it will also be appreciated that the interrupts may be of different duration and that the tools 32, 34 may or may not be unloaded or reversed during every interrupt.

Which forming profile to use depends on the components being formed and the properties of the metal being used. For example, it may be advantageous to interrupt the forming multiple times (have multiple interruption steps) since the temperature drop across the sheet blank will vary depending on the displacement of the ram. The sheet blank will be cooled by the cold tools when they are in contact, thus the portions of the die and sheet which contact earliest will equilibrate the earliest. Thus, it may be advantageous to form a first portion of the component, interrupt the process to permit the dislocations to reduce, then continue the forming to form a further portion of the component, and provide a second interruption to permit the dislocations to reduce in the newly formed portion, before completing the forming operation.

Figure 13:
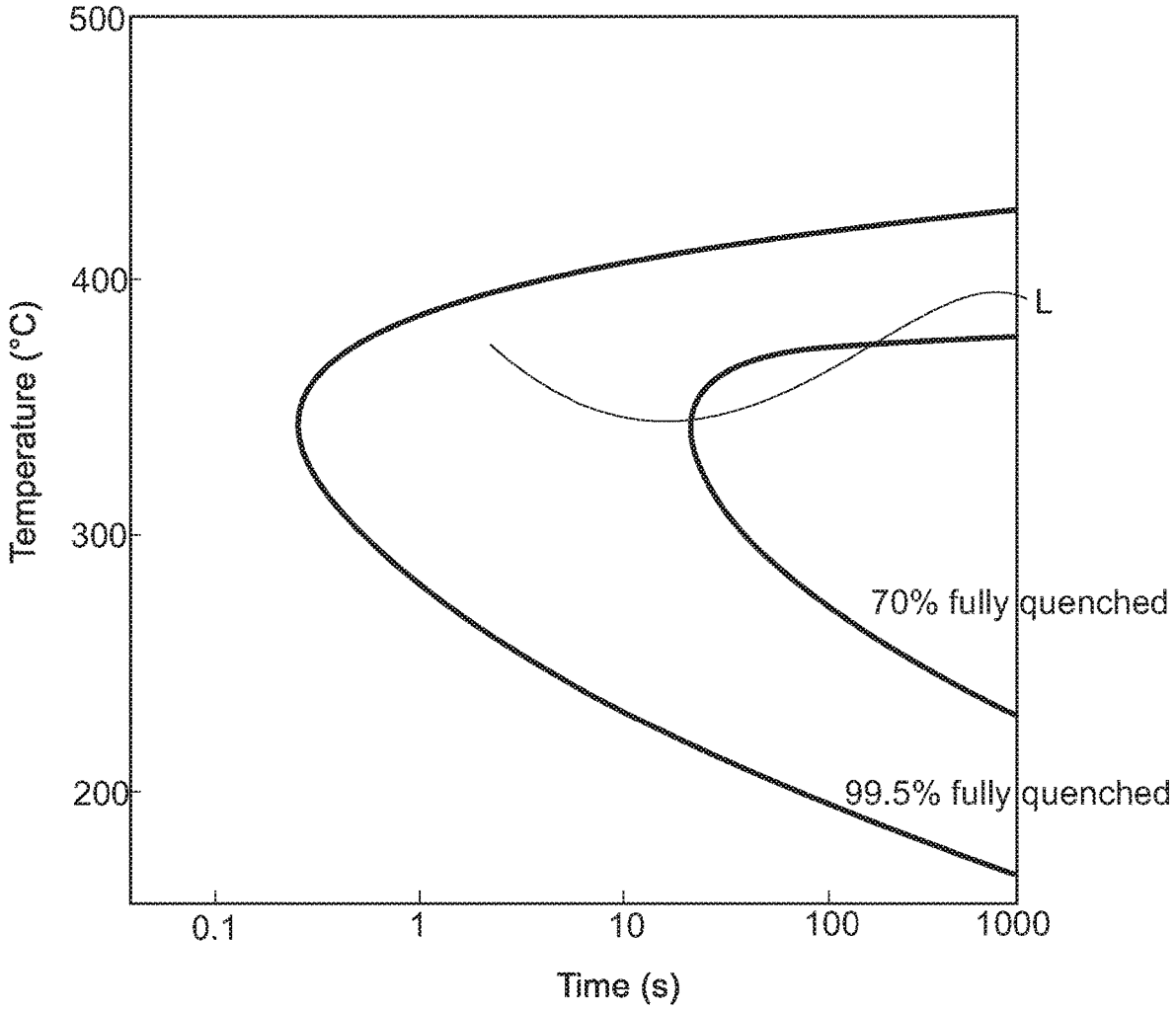
FIG. 13 is a TTP diagram for a 7075 alloy.
Figure 14:
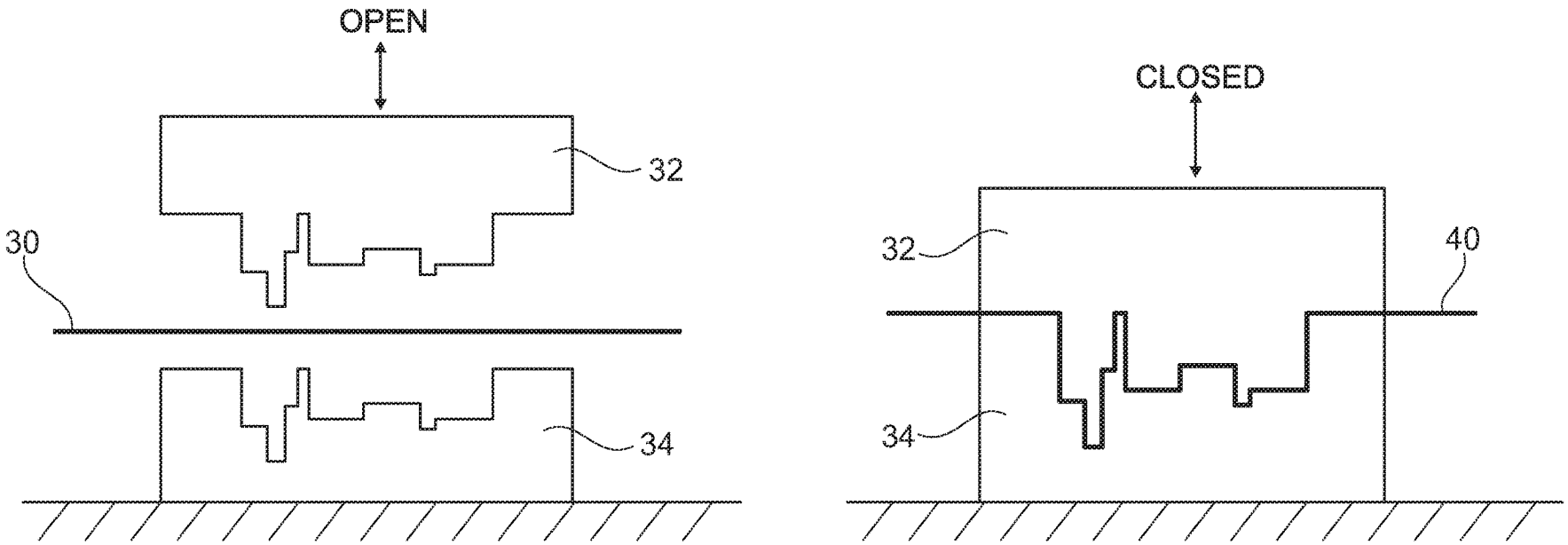
FIG. 14 is a diagrammatic representation of a press that may be used by the method of the present invention and shows the press in open and closed positions.

As mentioned in the introduction, it is desired that the process reduces and preferably eliminate the precipitation of precipitates from the SSS phase. To ensure this happens one must ensure that the temperature/time profile of the quench is such as to terminate any interruption step before the undesired phases are created and ensure that the overall quench rate is sufficient to avoid the formation of the undesirable phases represented by area in FIG. 12 enclosed by the C-curve that is formed from the locus of points at which precipitate phases as will form from the SSS. A material specific example is given in FIG. 13, in which the C-curve is generated by considering the locus of points at which the mechanical properties are reduced to 99.5% and then 70% from the optimally quenched material.

Figure 4:
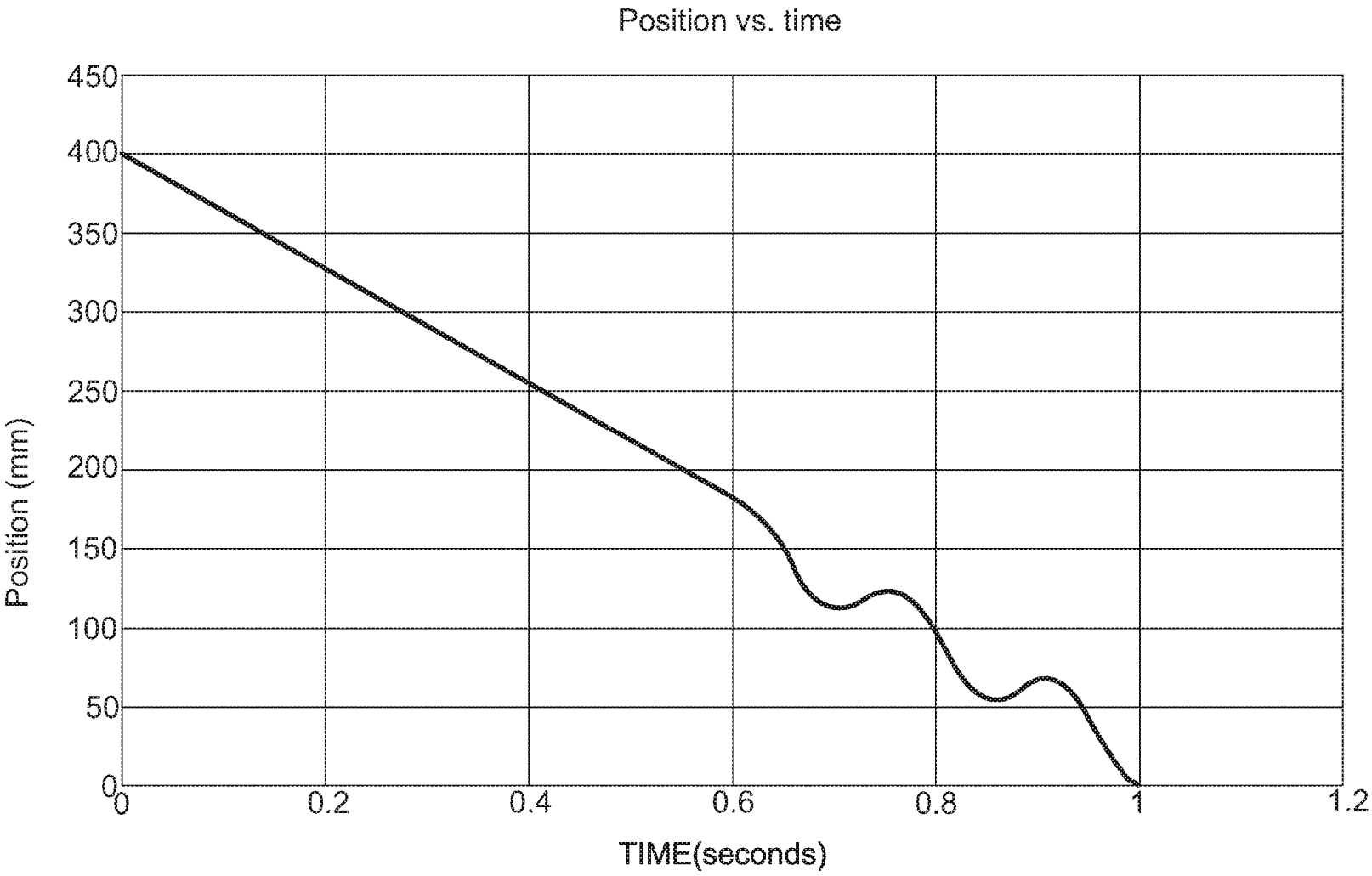
FIG. 4 illustrates a typical Position v Time profile for the moving portion of the matched tools used in the forming process of one aspect of the present invention.

A complex ram position vs. time plot is shown in FIG. 4, in which two short stroke reversals have been added to the stroke. Here the total forming time has been kept constant at 1 s whist adding approximately 0.1 s total of dwell time. During the HFQ® forming cycle the hot blank is first deformed between matching tools and then held under load between the tools. During the deformation stage some heat is transferred from the sheet to the tool. During the holding stage the final shape is quenched by the tools.

Pausing the forming cycle before the tools have mated can allow dislocation recovery to take place. For optimum results the tools are backed away (the cycle reversed). However, simply holding the tools can give sufficient time for recovery to occur.

The pause (or reversal) should occur as late in the forming cycle as is possible whilst also being at as high a temperature as possible so as to minimise the amount of plastic strain put into the material during the final finishing stage. To this end, it will be appreciated that having a first forming step which forms the component to as close to final form as possible will maximise the advantages of the present invention as the temperature of the sheet will still be high whilst the minimal remaining amount of pressing to final shape will minimise plastic strain. In the particular preferred arrangement, the component is pressed to over 90% and preferably between 95% and 98% of the final shape in a first pressing step. However, it will be appreciated that forming to over 50% of the final shape in the first forming step will still take advantage of the present invention as a portion of the dislocations formed in early deformation will be recovered leading to an overall partial reduction to the dislocation density within the finished component.

It will also be appreciated that some cooling of the blank occurs during deformation and there is, therefore, a trade-off between the temperature of the blank and the remaining strain.

There is some logic to having multiple stops during the forming process, since this will allow the fastest recovery of material brought into the tool at the early stages of forming.

Instantaneous changes of the stroke speed are not possible and any step change in speed will increase wear of the press. Therefore, it is most likely the press stroke will be interrupted by slowing the speed to a stop in a smooth manner.

Figure 5:
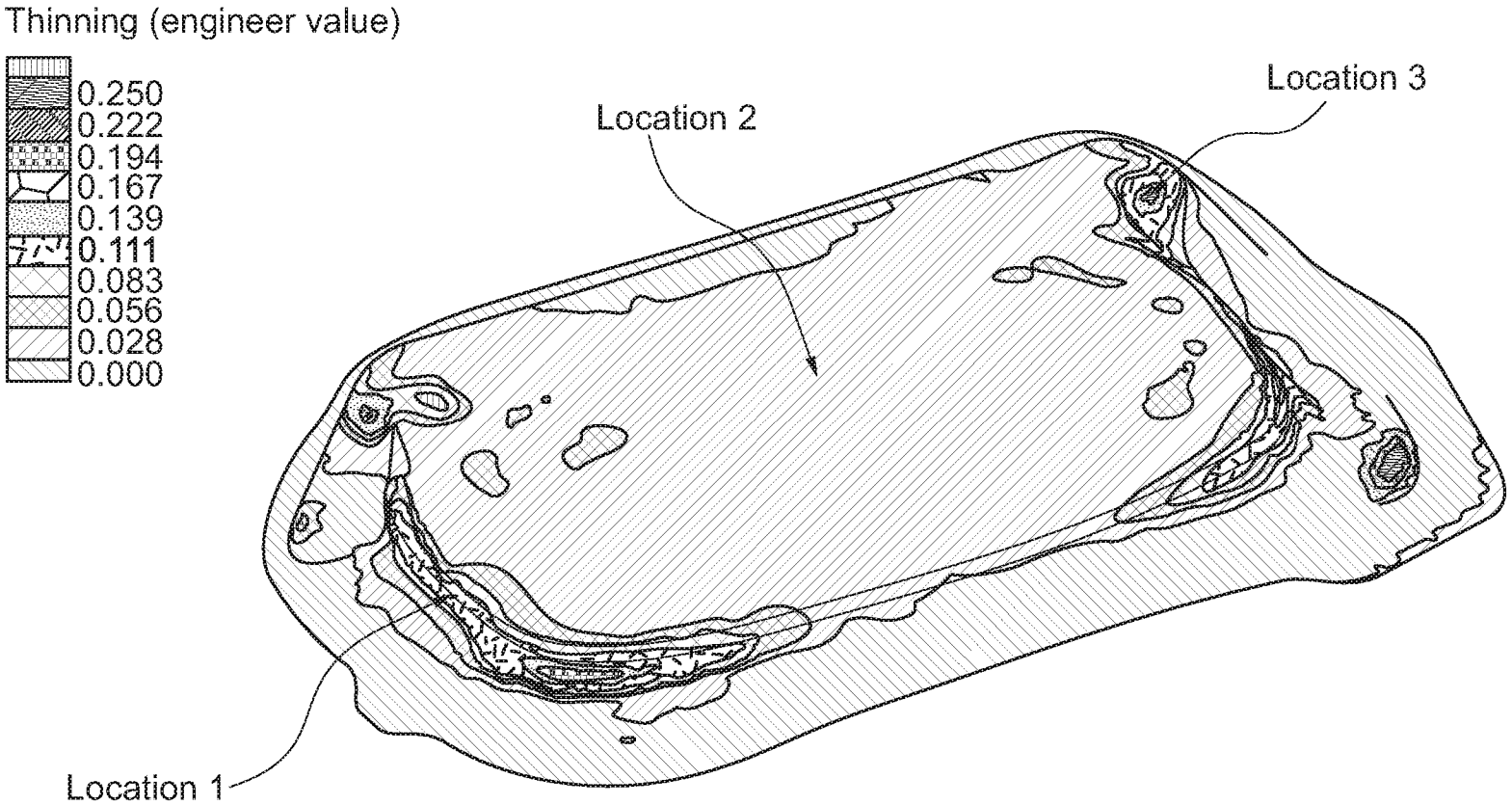
FIG. 5 shows a coupled thermo-mechanical finite element simulation model

FIG. 5 shows a coupled thermo-mechanical finite element simulation model which was created to give an example of how the method may be implemented. The model highlights the final position of three locations on the blank surface for which the thermal history and equivalent plastic strain history were tracked.

Three exemplary conditions have been tested:

A. Hold stroke
   i. Form at constant stroke speed to within 5 mm above fully formed
   ii. Hold for 4 s
   iii. Finalise deformation
B. Reverse stroke
   i. Form at constant stroke speed to within 5 mm above fully formed
   ii. Hold for 0.5 s
   iii. Reverse stroke to separate tools
   iv. Finalise stroke after a total hold of 4 s
C. Benchmark.
   i. Form at constant stroke speed to fully formed.

Figure 6:
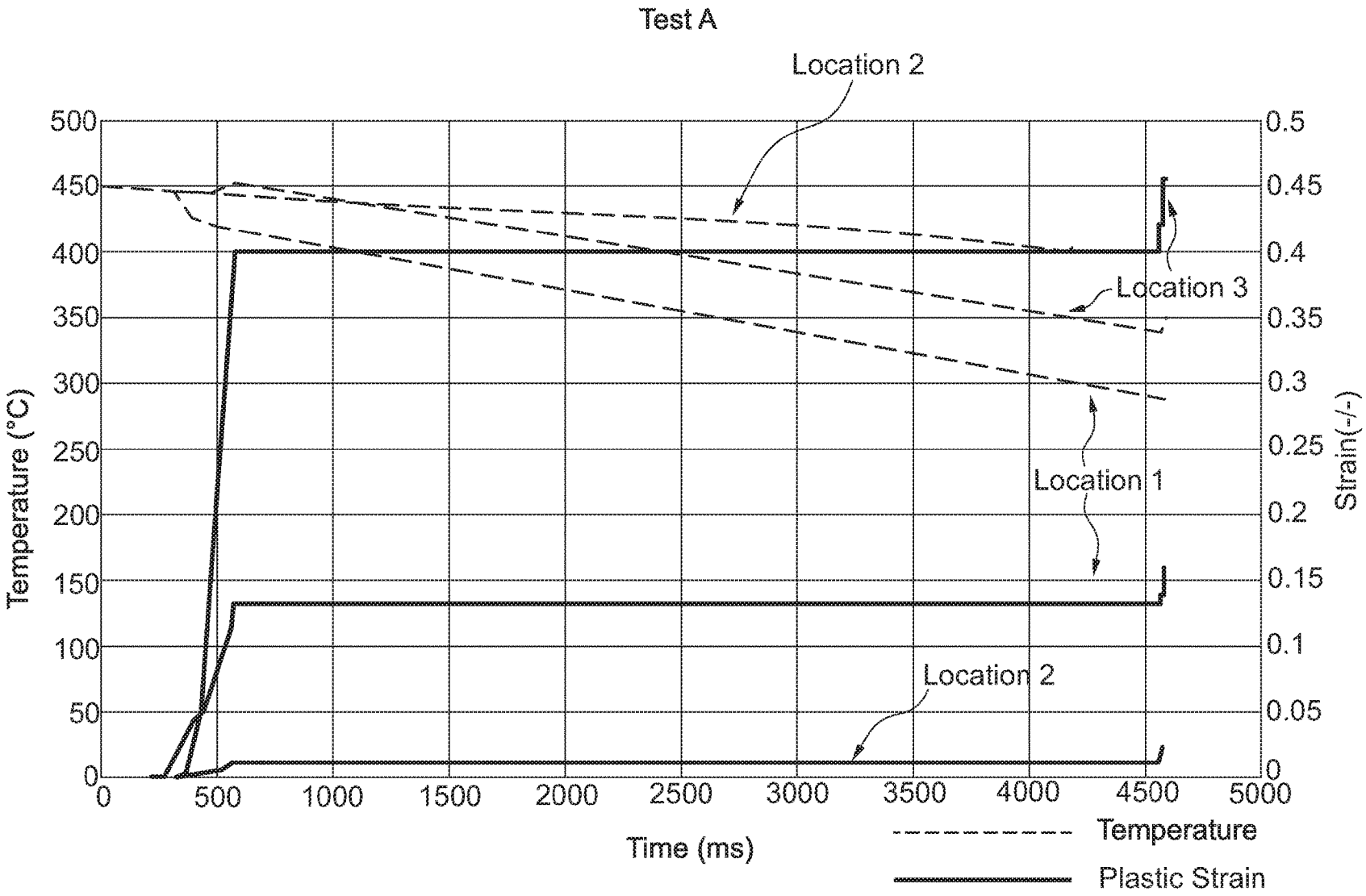
FIGS. 6, 7 and 8 illustrate a number of simulation results discussed later herein.
Figure 7:
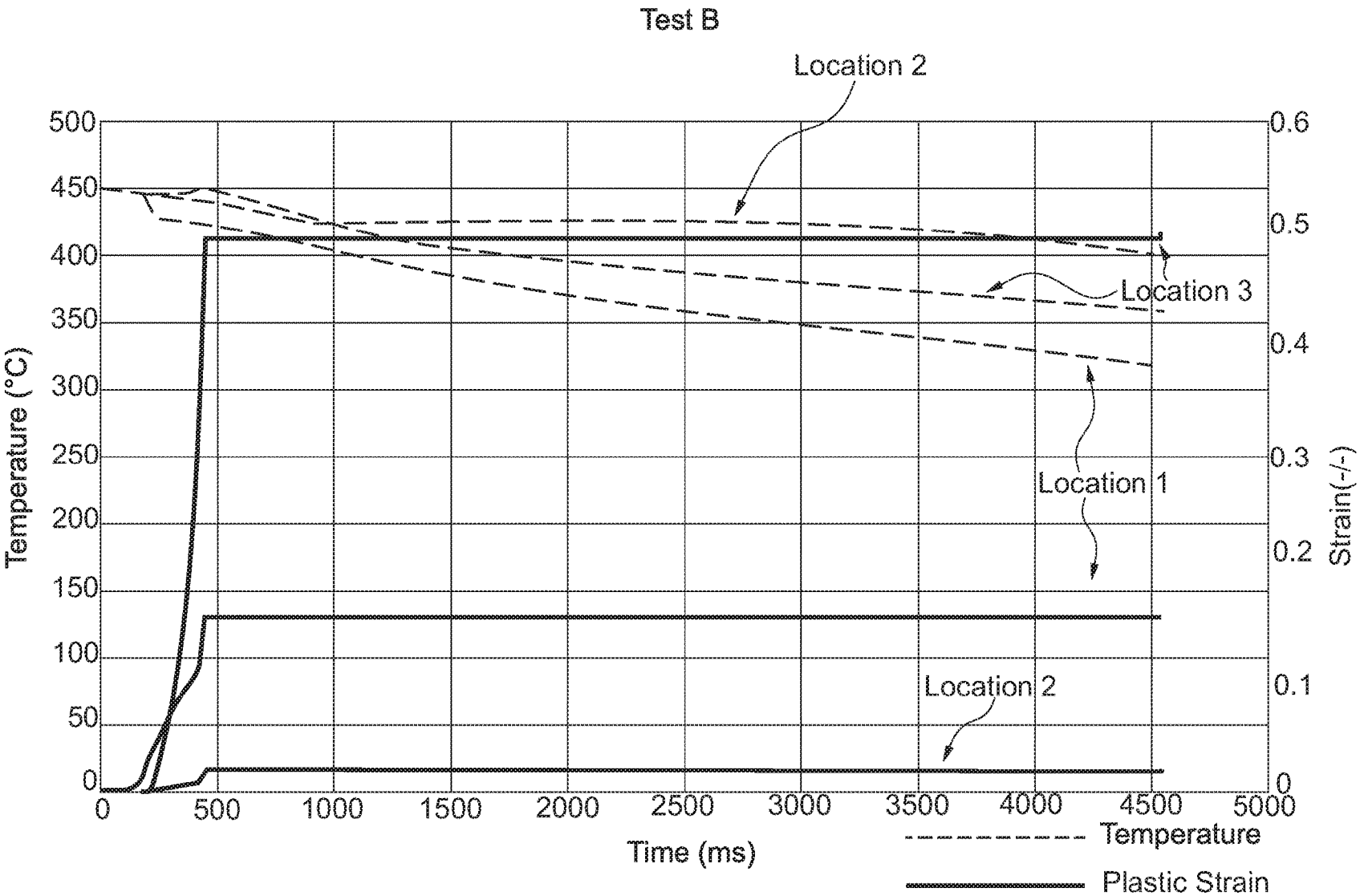
Figure 8:
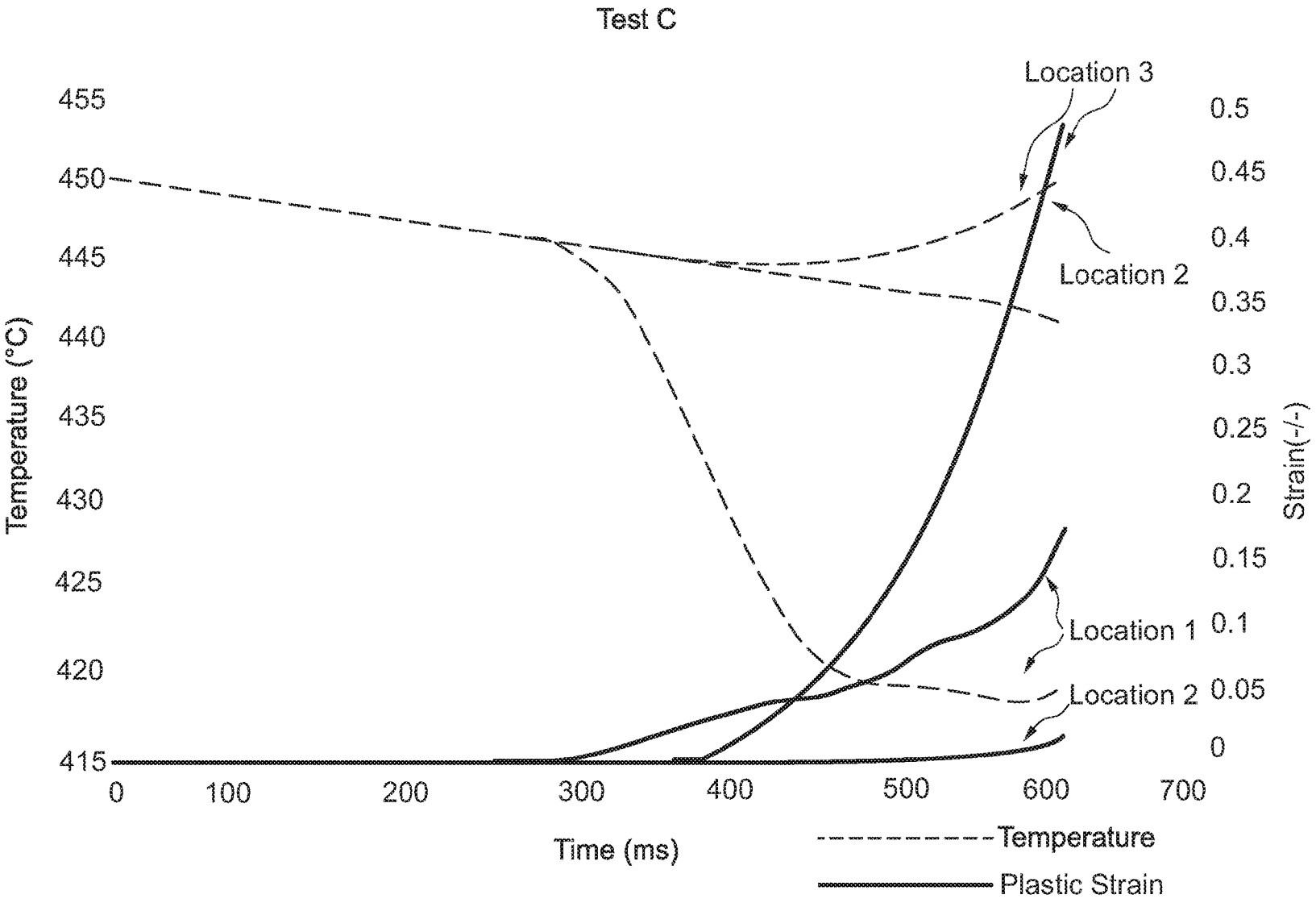

FIGS. 6, 7 and 8 plot the strain (solid line) and temperature (periodic line) histories of the three blank positions.

FIGS. 6, 7 and 8 reveal that reversal of the tools is beneficial to maintaining temperature during the dwell period. In both interrupted cases it can be seen the temperature can be maintained above 350 Deg C. for at least 2 s.

If the hold time is too long, then the slow cooling of the material will result in the formation of coarse precipitates. This limits the ability for the material to age harden, since the alloying elements precipitate to form the coarse precipitates during cooling rather than the fine precipitates during ageing. It is common to refer to this softening effect as annealing, although it is separate from the dislocation annealing (recovery) described above.

Figure 9:
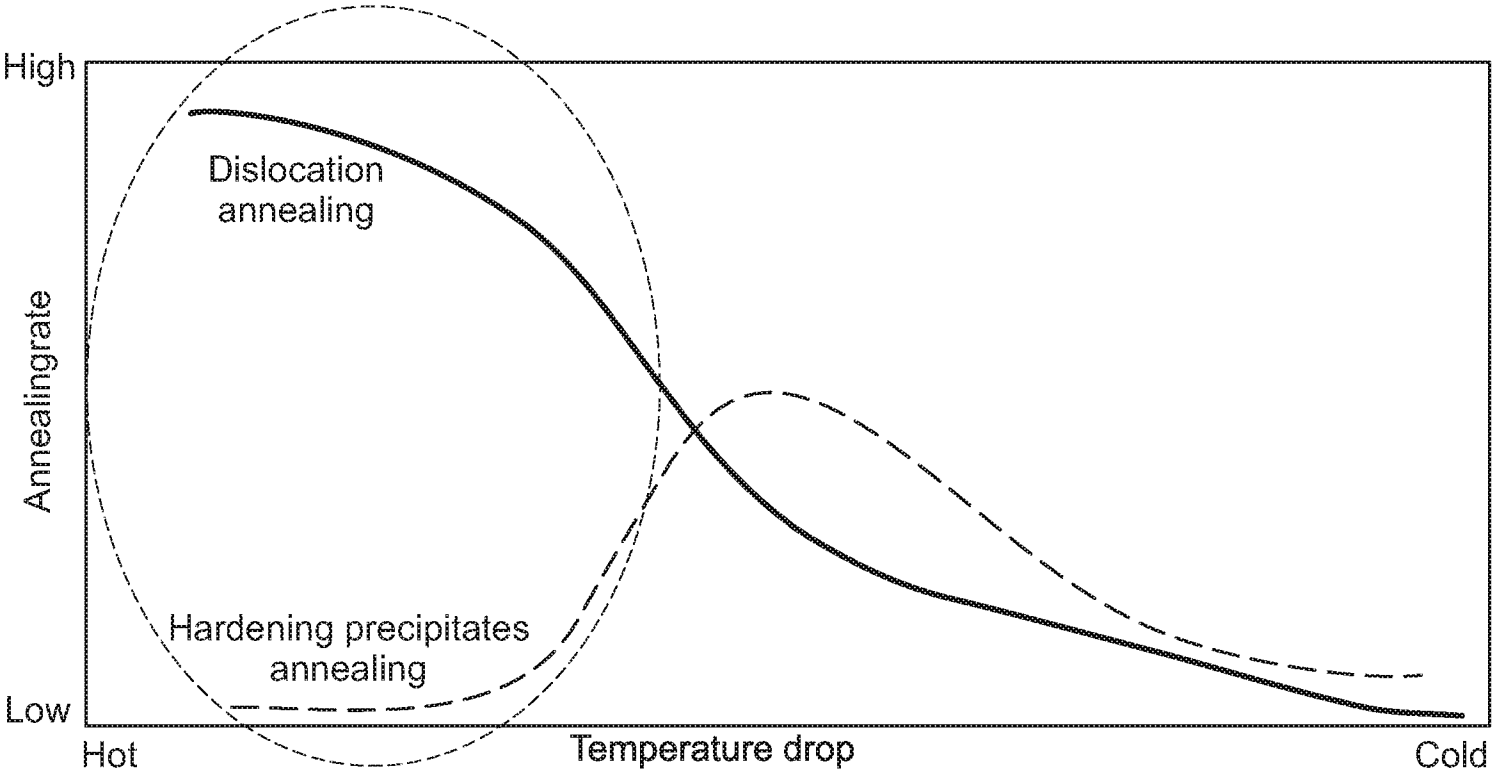
FIG. 9 is a graphical representation of annealing rate versus temperature drop.

FIG. 9 shows the effect schematically. To be optimal, the hold period should occur at the hottest blank temperature possible, for the shortest time possible thereby ensuring the strengthening elements remain in solid solution whilst the dislocations are recovered.

An indicative testing programme was created to prove the process on test equipment. Tensile samples were put through one of three regimes.

Figure 10:
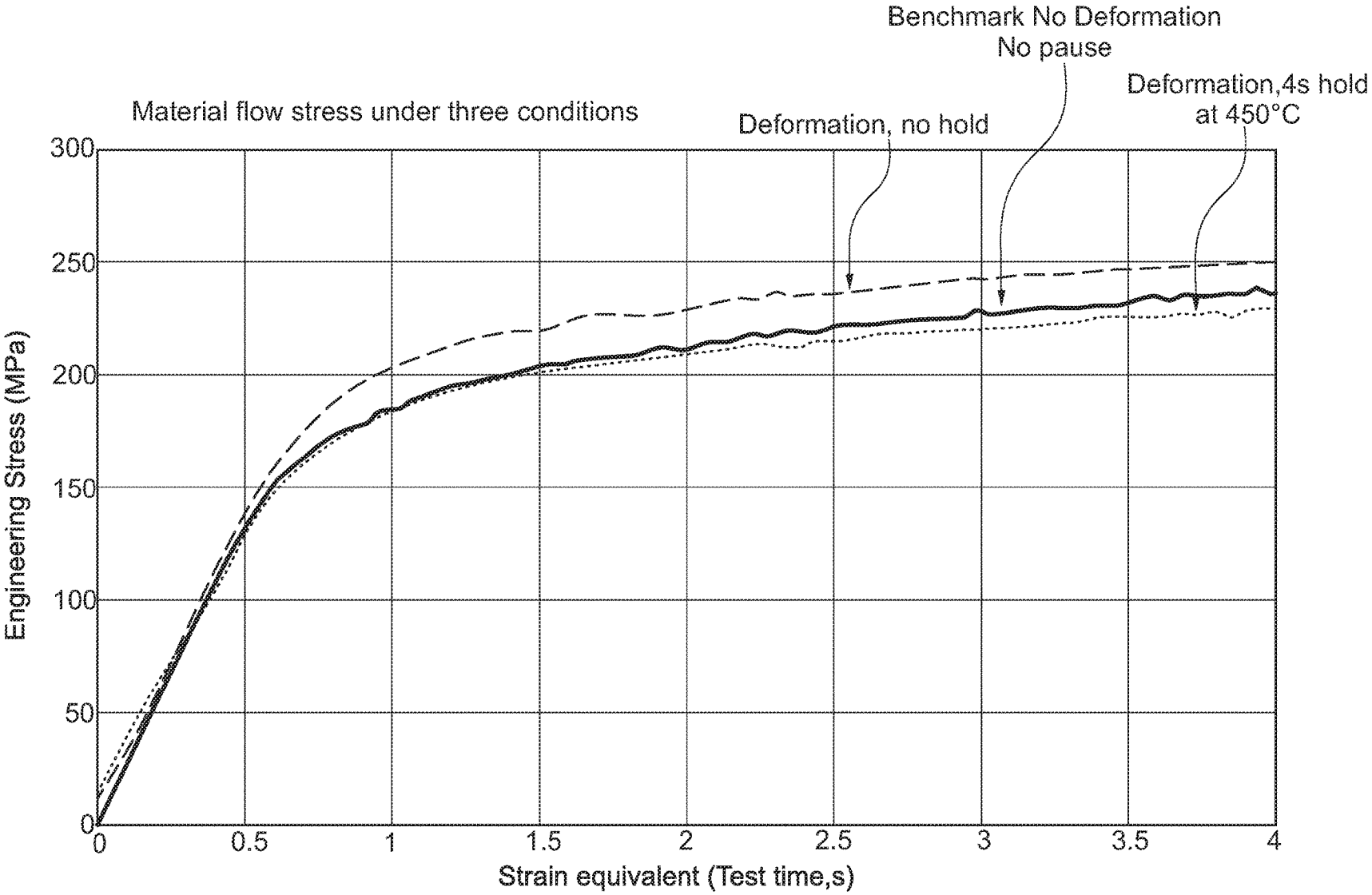
FIGS. 10 and 11 illustrate the differences between material flow stresses under three forming conditions, one of which relates to the present invention.

Tensile samples were put through one of three regimes:

1. Ageing with dislocation enhanced kinetics
   a. Solutionised
   b. Cooled to test temperature
   c. Pulled to induce strain
   d. Quenched
   e. Fast aged to an under-aged temper
2. Ageing without dislocation kinetics
   a. Solutionised
   b. Cooled to test temperature
   c. Quenched
   d. Fast aged to an under-aged temper
3. Ageing with dislocation annealing (recovery)
   a. Solutionised
   b. Cooled to test temperature
   c. Pulled to induce strain
   d. Interrupted
   e. Quenched
   f. Fast aged to an under-aged temper All samples were under-aged using the same fast age-hardening conditions. Therefore, the remaining strength of the samples will be directly proportional to the ageing kinetics. The results are shown in FIG. 10.

The results show a higher strength for the sample pulled but not held at temperature. The sample having no deformation and the sample with deformation and hold show identical yield characteristics. This is as expected and is in keeping with the deformation increasing ageing kinetics and the hold period providing sufficient recovery to remove the enhanced ageing kinetics.

Figure 11:
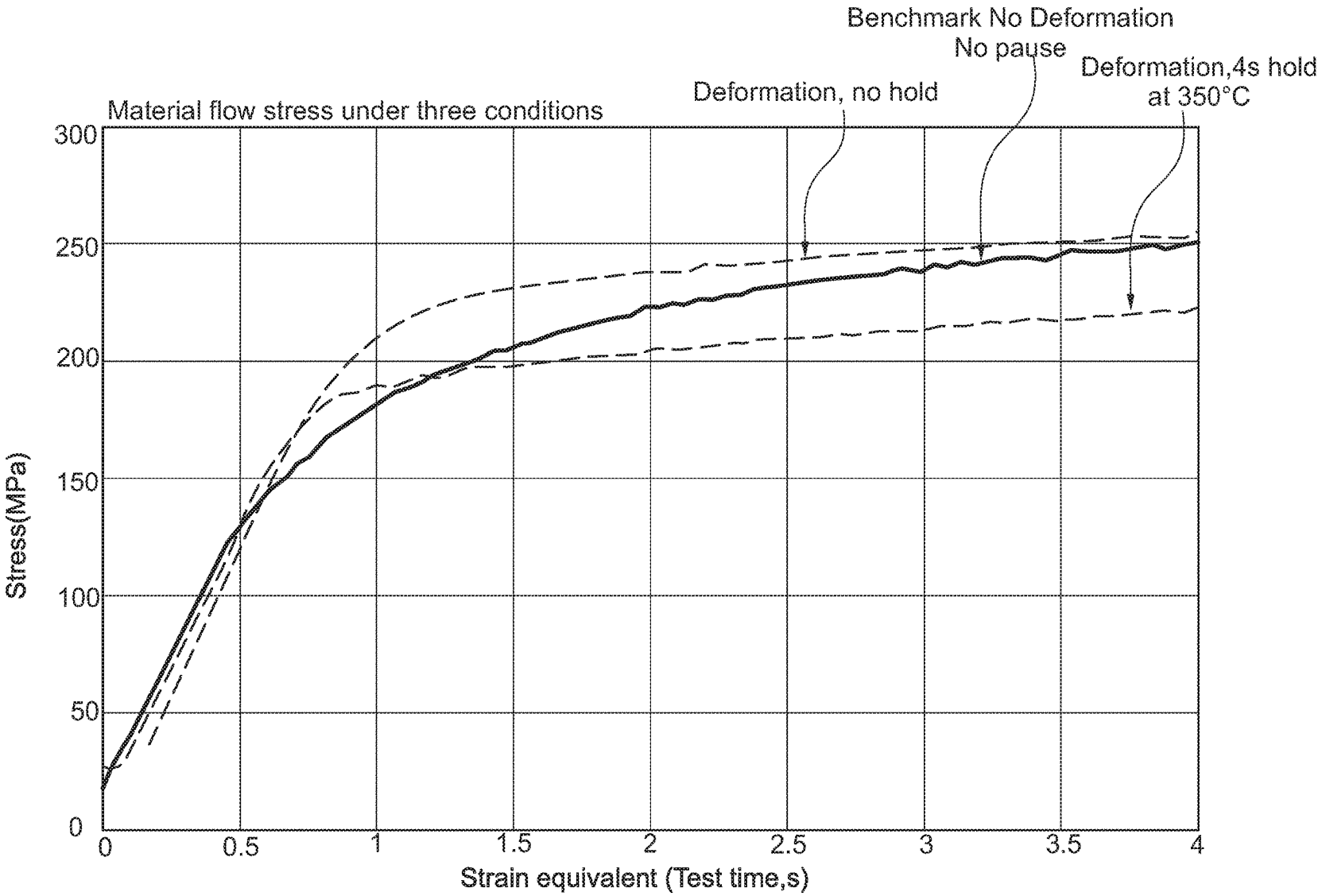

FIG. 11 shows a similar series of tests in which the hold temperature was reduced to 350° C. The sample held is now noticeably weaker than the benchmark. This is consistent with the formation of coarse precipitates. For the alloy considered, at 350° C. the hold time of 4 s is too long.

As would be understood by the skilled person, the Solution Heat Treatment (SHT) temperature is the temperature at which Solution Heat Treatment is carried out. The SHT temperature range varies depending on the alloy being treated. This may comprise heating the alloy to at least its solvus temperature, but below the solidus temperature. The method may include the step of maintaining the metal sheet blank at the Solution Heat Treatment temperature until Solution Heat Treatment is complete.

The metal may be an alloy. The metal sheet blank may comprise a metal alloy sheet blank. The metal alloy may comprise an aluminium alloy. For example, the alloy may comprise an aluminium alloy from the 6xxx, 7xxx, or 2xxx alloy families. Alternatively, the alloy may comprise a magnesium alloy, such as a precipitation hardened magnesium alloy e.g. AZ91.

The press may comprise a set of matched tools 32, 34. The tools 32, 34 may be cold tools, heated tools or cooled tools. Initiating forming may comprise closing the tools together e.g. reducing the displacement between the tools. Completing forming may comprise closing the tools together until the final position, whereby the component is fully formed, is reached. In one embodiment, this may be when the displacement between the tools is at a minimum. It will be appreciated that the word "cold" is a relative term as the tools should be colder than the heated metal sheet but may still be war or even hot to the touch. Typically, this process might use tools heated or cooled to within the temperature range of −5° C. to +120° C.

The process may comprise transferring the sheet blank to a set of cold tools. The process may comprise initiating forming within 10 s of removal from the heating station so that heat loss from the sheet blank is minimised. The process may comprise holding the formed component in the tools during cooling of the formed component.

The process may be capable of being carried out on any press that can be interrupted during its down stroke. The press may be a hydraulic press.

Initiating forming in a press and/or a first pressing step may comprise closing the press tools by at least 10% of the total displacement. Alternatively, it may comprise closing the press by at least 20, at least 30, at least 40, at least 50, at least 60, at least 70, at least 80, at least 90 or substantially 100% of the total displacement. The initial pressing may close the tools to within 95% of the total pressing, or even until the tool is essentially closed but before quenching load is applied.

Interrupting forming of the component and/or the interruption step or steps may comprise any as one or more of: pausing or holding the press tools in position; reversing the press; and combinations thereof.

Reversing the press tools may comprise moving the tools relatively apart. The press may be reversed so that one or more of the tools, or a portion thereof, no longer contacts the sheet blank.

For example, the interruption may comprise holding the press tools in position, then reversing the press. Alternatively, the interruption may comprise reversing the press, then holding the press tools in position. The interruption may comprise pausing or holding the press tools in position one or more times, and reversing the press one or more times. For example, the interruption may comprise first holding the press tools in position, then reversing the press, then holding the press tools for a second time in a second position.

The interruption step, (for example a pause, hold and/or reversal) may be incorporated into the process to coincide with a switching between pressing modes e.g. a gravity-driven (e.g. a fast descent) and powered ram descent modes. The total interruption time may be less than 10 seconds and may be less than 5 seconds, such as 4 seconds or 1 second. The total interruption time may be less than 1 second, such as 0.5 or 0.2 seconds. The total interruption time may be at least 0.1 seconds, or at least 0.2, 0.5, 1, 1.5, 2, 3, 4, or 5 seconds.

Initiating forming of the component may be carried out at a first speed, and completing forming of the component may be carried out at a second speed, different to the first. Continuing forming i.e. between interruptions, may be carried out at the first, second, or a third speed. In some embodiments, the forming speed may remain constant or substantially constant throughout the forming step or pressing step.

In one series of embodiments the forming speed is variable throughout one or more of the forming steps e.g. initiating forming, continuing forming and/or completing forming. For example the first pressing step and/or the second or further pressing step may have a variable pressing speed. The pressing speed may increase during the step, decrease during the step, or combinations thereof. The speed may reach a maxima or minima during a mid-point of the forming step e.g. the press speed may accelerate to a maxima and then reduce to zero for the interrupt. The press velocity profile may decrease smoothly towards the end of a pressing step until the interruption or interruption step begins. The press velocity profile may be optimised to remove step changes in velocity e.g. to reduce wear.

The process may comprise, maintaining the metal sheet blank at the Solution Heat Treatment temperature until Solution Heat Treatment is complete. The Solution Heat Treatment may be complete when the desired amount of the alloying element or elements responsible for precipitation or solution hardening have entered solution. For example, the Solution Heat Treatment may be complete when at least 50% of the alloying element or elements have entered solution. Alternatively, the Solution Heat Treatment may be complete when at least 60, 70, 75, 80, 90, 95 or substantially 100% of the alloying element or elements have entered solution. Heating the metal alloy sheet blank to its Solution Heat Treatment temperature may comprise heating the sheet blank to at least its solvus temperature. The process may comprise heating the blank to above its solvus temperature but below its solidus temperature.

In a series of embodiments, the blank is heated to at least 420°, 440°, 450°, 460°, 470°, 480°, 500°, 520°, or 540° C. In a series of embodiments, the blank is heated to not more than 680°, 660°, 640°, 620°, 600°, 580°, 560° or 540° C. In one embodiment, the blank is heated to between 470° C. and 490° C. (typical of 7075 alloy). In another embodiment the blank is heated to between 525° C. and 560° C. (typical of 6082 alloy).

It will be appreciated that the sheet will have a Liquidus temperature at which all components thereof are in the liquid phase and that the process is conducted below the Liquidus temperature.

By the above processes, it is possible to form an improved component from a metal sheet blank which has a reduced quantity of dislocations while not being adversely affected by precipitation during the forming steps.

The invention claimed is:

1. A method of forming a component from an alloy sheet of material aluminum alloy or magnesium alloy having at least a Solvus temperature and a Solidus temperature of a precipitation hardening phase, the method comprising the steps of:

a. heating the alloy sheet to above its Solvus temperature;

b. initiating forming the heated alloy sheet between matched tools of a die press and forming by means of plastic deformation towards a final shape whilst allowing the average temperature of the alloy sheet to reduce at a first predetermined rate A;

c. interrupting the forming of the alloy sheet for a predetermined first interruption period P1 prior to achieving said final shape; and, during the interrupt holding the alloy sheet with reduced or no deformation and allowing the average temperature of the alloy sheet to reduce at a second pre-determined rate B lower than or equal to the first predetermined rate in order to allow for a reduction in dislocations;

d. maintaining the interrupt step for a time such as to ensure the Dislocation Density is reduced whilst avoiding the precipitation of unwanted phases;

e. completing the forming of the heated alloy sheet into the final shape whilst allowing the alloy sheet to cool at a third rate C greater than said second pre-determined rate B.

2. The method as claimed in claim 1 in which the alloy sheet is heated to within its Solution Heat Treatment temperature range during step(a).

3. The method as claimed in claim 1, wherein said alloy sheet is formed to at least 50% of its final form during the initial forming of step (b).

4. The method as claimed in claim 1, wherein said alloy sheet is formed to at least 90% of its final form during the initial forming of step (b).

5. The method as claimed in claim 1 and including a second interruption period P2 after the first interrupt period P1 and before completion of the forming of step (e).

6. The method as claimed in claim 1 and including multiple further interruption periods PX after the first interrupt period P1 and before completion of the forming of step (e).

7. The method as claimed in claim 1 and wherein the method includes one or more interruption periods P1, P2, PX and wherein one or more of said one or more interruption periods includes a step of holding the matched tools in position.

8. The method as claimed in claim 1 and wherein the method includes one or more interruption periods P1, P2, PX and wherein one or more of said one or more interruption periods includes a step of reversing the matched tools.

9. The method as claimed in claim 1 and wherein the method includes one or more interruption periods P1, P2, PX and wherein one or more of said one or more interruption periods includes a step of holding and reversing the matched tools.

10. The method as claimed in claim 1 and wherein the method includes one or more interruption periods P1, P2, PX and wherein the method includes the step of terminating the interruption period or periods prior to the precipitation of undesirable precipitates from a super saturated solid solution.

11. The method according to claim 1, wherein the temperature of the alloy sheet is maintained at a temperature of between 350° C. and 500° C. during the interrupt of step (c).

12. The method according to claim 1, wherein the temperature of the alloy sheet is maintained at a temperature above 250° C. during the interrupt of step (c).

13. The method according to claim 1 and including a step of maintaining the matched tools at a temperature of between −5° C. and +120° C. during the interrupt of step (c).

14. The method as claimed in claim 1 and wherein the alloy sheet comprises an alloy from the 2xxx, 6xxx or 7xxx alloys.

15. The method as claimed in claim 1 and wherein the alloy sheet is held during the interrupt of step (c) without deformation.

16. The method as claimed in claim 1 and including a step of maintaining the metal sheet blank at a Solution Heat Treatment temperature until Solution Heat Treatment is complete.

17. A method as claimed in claim 1 and including a step of holding a finished component between the matched tools after completion of step (e).

* * * * *